US011052678B1

(12) United States Patent
Baker et al.

(10) Patent No.: US 11,052,678 B1
(45) Date of Patent: Jul. 6, 2021

(54) DRYER PLATENSTHAT ATTENUATE IMAGE DEFECTS IN IMAGES PRINTED ON SUBSTRATES BY AQUEOUS INK PRINTERS

(71) Applicant: Xerox Corporation, Norwalk, CT (US)

(72) Inventors: John Baker, Webster, NY (US); Paul J. McConville, Webster, NY (US); Linn C. Hoover, Webster, NY (US); David S. Derleth, Webster, NY (US); Michael J. Linder, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/783,715

(22) Filed: Feb. 6, 2020

(51) Int. Cl.
*B41J 11/00* (2006.01)
*B41J 11/02* (2006.01)

(52) U.S. Cl.
CPC ..... *B41J 11/002* (2013.01); *B41J 11/0022* (2021.01); *B41J 11/02* (2013.01)

(58) Field of Classification Search
CPC ..... B41J 11/002; B41J 11/02; B41J 11/0022
See application file for complete search history.

(56) References Cited

U.S. PATENT DOCUMENTS 4,469,026 A * 9/1984 Irwin ..... B41F 23/0443 101/232
5,612,672 A * 3/1997 Ino ..... F01P 7/048 340/449
6,293,196 B1 * 9/2001 DeMoore ..... B41F 23/0426 101/424.1
2002/0067403 A1 6/2002 Smith
2002/0071017 A1 6/2002 Pitpit et al.
2007/0247505 A1 10/2007 Isowa et al.
2009/0031579 A1 * 2/2009 Piatt ..... F26B 3/28 34/82
2014/0245950 A1 * 9/2014 Seccombe ..... B41J 11/002 118/620
2015/0029281 A1 1/2015 Cressman et al.
2015/0091996 A1 4/2015 Piatt et al.
2015/0165790 A1 6/2015 Rosati et al.
2015/0375533 A1 12/2015 Hobo et al.
2016/0060052 A1 3/2016 Tojima et al.
2016/0067985 A1 3/2016 Akahiri et al.

* cited by examiner

*Primary Examiner* — Sharon Polk
(74) *Attorney, Agent, or Firm* — Maginot Moore & Beck LLP

(57) ABSTRACT

An inkjet printer includes a dryer configured to attenuate cockle in the substrates under the heater of the dryer and reduce ink transfer from ink images during duplex printing without adversely affecting the cooling of the substrates exiting the dryer. The dryer has at least two plenums with at least one plenum opposite a heater and at least one plenum opposite an air vent. A platen covers the plenum opposite the air vent and the platen has a plurality of protuberances arranged in a non-linear arrangement so the protuberances contact substrates being carried by a plurality of endless belts over the plenum to prevent the substrates from contacting a surface of the platen. Another platen covers the plenum opposite the heater and this platen has non-linear members on its surface to support the substrates and reduce cockle while the ink is dried by the heater.

31 Claims, 5 Drawing Sheets

DRYER PLATENSTHAT ATTENUATE IMAGE DEFECTS IN IMAGES PRINTED ON SUBSTRATES BY AQUEOUS INK PRINTERS

TECHNICAL FIELD

This disclosure relates generally to aqueous ink printing systems, and more particularly, to platens used in dryers in such printers.

BACKGROUND

Known aqueous ink printing systems print images on uncoated and coated substrates.

Whether an image is printed directly onto a substrate or transferred from a blanket configured about an intermediate transfer member, once the image is on the substrate, the water and other solvents in the ink must be substantially removed to fix the image to the substrate. A dryer is typically positioned after the transfer of the image from the blanket or after the image has been printed on the substrate for removal of the water and solvents. To enable relatively high speed operation of the printer, the dryer heats the substrates and ink to temperatures that typically reach above 100° C. for effective removal of the liquids from the surfaces of the substrates.

Coated substrates exacerbate the challenges involved with removing water to fix the ink images to the substrates as the low porosity of the clay coatings can prevent ink from wicking into the media substrates. A prior art dryer is shown in the printer of FIG. 4. The dryer 160 has a heater 192, a vent system 196, vacuum plenums 184 and 186, vacuum blowers 188, and electric motors 174. The vacuum plenums 184 and 186 are typically metal rectangular boxes, each of which has four sidewalls, a bottom wall, and a top platen. The volumes of the plenums are pneumatically connected to the corresponding vacuum blower 188, which pulls an air flow through the perforated platens of the plenums. One or more endless belts 164 extend between rollers 168 and 172 so the belts 164 slide over the platens. The belts also include holes so air can be pulled through the belts as they slide over the openings in the platens carrying media substrates. The air being pulled by the vacuum blower 188 passes through the substrates, the holes in the belts, and the perforated platens to produce a force that holds the substrates against the belts as the substrates pass through the dryer 160. The first plenum 184 is positioned opposite the heater 192, which typically includes an array of infrared (IR) radiators that heat the ink images on the substrates to fix the images to the substrates. A portion of the plenum 186 is opposite the vent system 196. As the heat in the dryer evaporates the liquid ink on the substrates, water vapor and vapor of the solvents in the inks are produced. The air vent system 196 pulls air from the air near the exit of the dryer 160 to vent the water vapor and solvent vapor from the dryer to prevent water and solvent condensation on the images and to aid in the cooling of the substrates so they can be safely touched after they are deposited in an output tray 200 of the printer.

One issue that arises from the dryer 160 occurs when substrates that exit the dryer 160 are recirculated through the marking unit 140 past the printheads 148 by path diverters (not shown) as known. When the previously printed sides of the substrates reach the portion of the platen of plenum 186 that is opposite the air vent system 196, ink is transferred from the image onto the platen covering the plenum. This transfer occurs because the substrate is still relatively warm as it was heated by the heater 192 but the platen opposite the air vent system 196 stays relatively cool because the vented air carries heat from the platen. This temperature differential between the ink images on the first printed side of the substrates and the platen surface opposite the air vent system 196 causes ink to stick to the platen surface. Consequently, the first printed sides of the duplex images exhibit scratches. Configuring a dryer to reduce the temperature differential between the substrates and the platen opposite the air vent system sufficiently to make ink transfer to the platen imperceptible without adversely impacting the cooling of the substrates exiting the dryer would be beneficial.

SUMMARY

A new printer includes a dryer that attenuates ink transfer from ink images during duplex printing without adversely affecting the cooling of the substrates exiting the dryer. The printer includes at least one printhead configured to eject drops of an ink onto substrates moving past the at least one printhead to form ink images on the substrates, and a dryer having a heater, an air vent, at least two plenums with at least one plenum being opposite the heater and at least one plenum being opposite the air vent, a first plurality of endless belts configured to rotate in a process direction about the at least one plenum opposite the heater and a second plurality of endless belts configured to rotate about the at least one plenum opposite the air vent, and a platen positioned to cover the plenum opposite the air vent so the second plurality of endless belts moves over the platen as the endless belts in the second plurality of endless belts rotate about the at least one plenum opposite the air vent, the platen having a plurality of protuberances in a non-linear arrangement between each pair of adjacent endless belts in a cross-process direction that is perpendicular to the process direction so the protuberances contact substrates being carried by the second plurality of endless belts to prevent the substrates from contacting a surface of the platen.

A new dryer for an aqueous ink printing system attenuates ink transfer from ink images during duplex printing without adversely affecting the cooling of the substrates exiting the dryer. The dryer includes a heater, an air vent, at least two plenums, at least one plenum is opposite the heater and at least one plenum is opposite the air vent, a first plurality of endless belts configured to rotate in a process direction about the at least one plenum opposite the heater, a second plurality of endless belts configured to rotate about the at least one plenum opposite the air vent; and a platen positioned to cover the plenum opposite the air vent so the second plurality of endless belts moves over the platen as the endless belts in the second plurality of endless belts rotate about the at least one plenum opposite the air vent, the platen having a plurality of protuberances in a non-linear arrangement between each pair of adjacent endless belts in a cross-process direction that is perpendicular to the process direction so the protuberances contact substrates being carried by the second plurality of endless belts to prevent the substrates from contacting a surface of the platen.

A new platen covers a plenum of a dryer in an aqueous ink printing system to attenuate ink transfer from ink images during duplex printing without adversely affecting the cooling of the substrates exiting the dryer. The platen includes a planar member having a length in a process direction and width in a cross-process direction perpendicular to the process direction that covers the plenum that is opposite the air vent so a plurality of endless belts moves over the planar member as the endless belts in the plurality of endless belts rotate about the plenum that is opposite the air vent, and a plurality of protuberances extending from a surface of the planar member, the plurality of protuberances being configured in a non-linear arrangement between each pair of adjacent endless belts in the cross-process direction so the protuberances contact substrates being carried by the plurality of endless belts to prevent the substrates from contacting the surface of the planar member.

BRIEF DESCRIPTION OF THE DRAWINGS

The foregoing aspects and other features of a dryer that attenuates ink transfer from ink images during duplex printing without adversely affecting the cooling of the substrates exiting the dryer are explained in the following description, taken in connection with the accompanying drawings.

DETAILED DESCRIPTION

Figure 1:
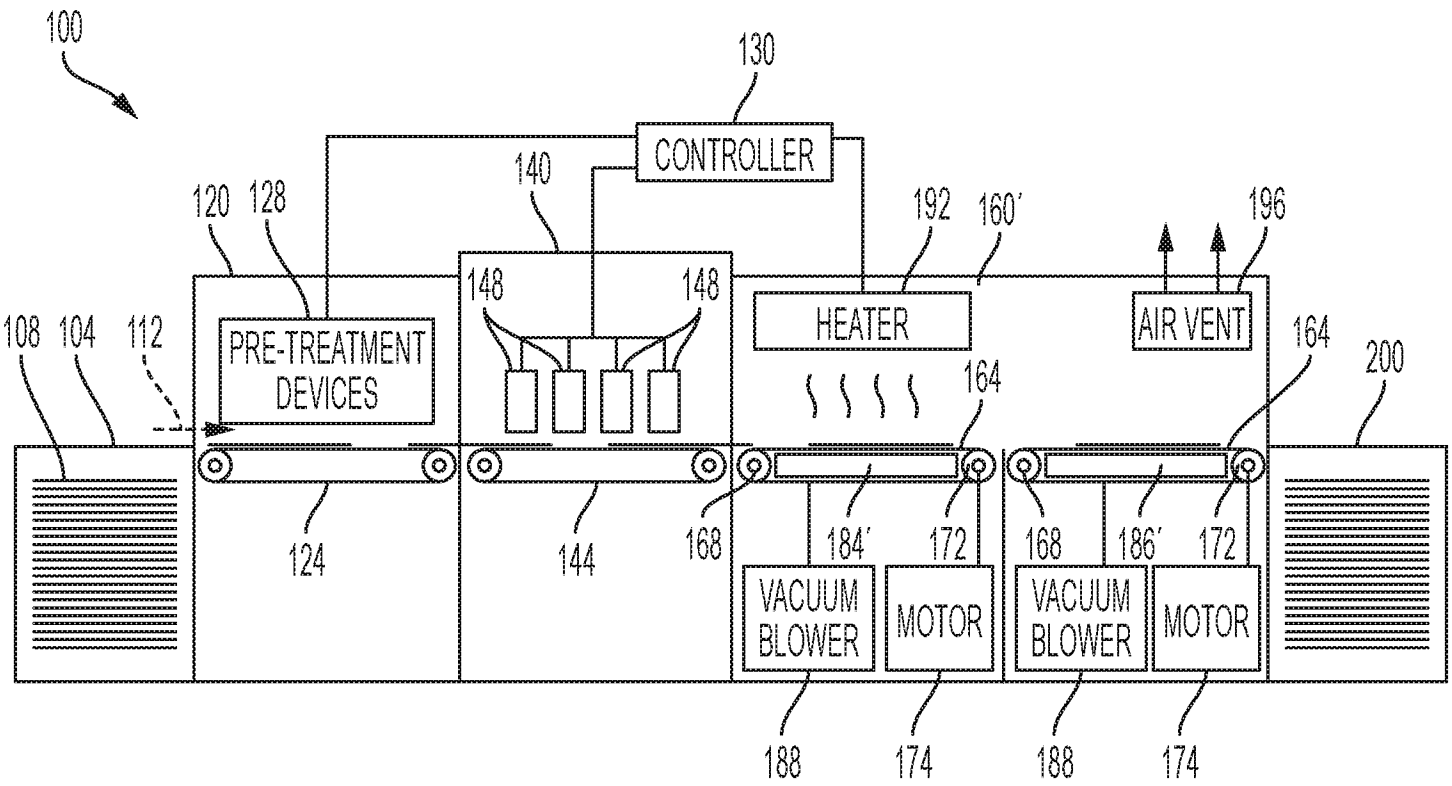
FIG. 1 is a schematic diagram of an aqueous ink printing system having a dryer that includes the platen of FIG. 2 and the platen of FIG. 3 to attenuate cockle in the substrates under the heater and reduce ink transfer from ink images during duplex printing without adversely affecting the cooling of the substrates exiting the dryer.

For a general understanding of the present embodiments, reference is made to the drawings. In the drawings, like reference numerals have been used throughout to designate like elements.

FIG. 1 depicts a block diagram of an aqueous printer 100 that is configured to print images on substrates that are dried by a new dryer configured to attenuate cockle in the substrates under the heater of the dryer and reduce ink transfer from ink images during duplex printing without adversely affecting the cooling of the substrates exiting the dryer. The printer 100 includes a media supply 104, a pretreating unit 120, a marking unit 140, and a dryer 160'. The media supply 104 stores a plurality of media sheets 108 for printing by the printer 100. The media sheets 108 may, in some embodiments, be clay-coated or other types of treated paper.

The pretreating unit 120 includes at least one transport belt 124, which receives the media sheets 108 from the media supply 104 and transports the media sheets 108 in a process direction 112 through the pretreating unit 120. As used in this document, the term "process direction" refers to the direction in which the substrates move as they are printed and processed by the printer and the term "cross-process direction" means a direction perpendicular to the process direction in the plane of the moving substrates. The pretreating unit 120 includes one or more pretreating devices 128 that condition the media sheets 108 and prepare the media sheets 108 for printing in the marking unit 140. The pretreating unit 120 may include, for example, one or more coating devices that apply a coating to the media sheets 108, a drying device that dries the media sheets 108, and a heating device that heats the media sheets 108 to a predetermined temperature before printing. In some embodiments, the printer 100 does not include a pretreating unit 120 and media sheets 108 are fed directly from the media supply 104 to the marking unit 140. In other embodiments, the printer 100 may include more than one pretreating unit.

The marking unit 140 includes at least one marking unit transport belt 144 that receives the media sheets 108 from the pretreating unit 120 or the media supply 104 and transports the media sheets 108 through the marking unit 140. The marking unit 140 further includes at least one printhead 148 that ejects aqueous ink onto the media sheets 108 as the media sheets 108 are transported through the marking unit 140. In the illustrated embodiment, the marking unit 140 includes four printheads 148, each of which ejects one of cyan, magenta, yellow, and black ink onto the media sheets 108. The reader should appreciate, however, that other embodiments include other printhead arrangements, which may include more or fewer printheads, arrays of printheads, and the like.

With continued reference to FIG. 1, dryer 160 includes two sets of media transport belts 164, one of which receives the media sheets 108 from the marking unit 140 and the other carries the media sheets to the exit of the dryer. Each set of belts 164 is tensioned between an idler roller 168 and a driven roller 172. Both of the driven rollers are driven by electric motors 174, although they could be driven by a single motor. As shown in FIG. 1, each plenum 184 and 186 is connected to a vacuum blower to produce a vacuum within each plenum, although a single vacuum blower could be connected to both of the plenums for this purpose. The dryer 160 is configured with a heater 192 that heats the printed substrates to an adequate temperature to remove the water and solvents in the aqueous ink on the substrates. The heater 192 can be one or more arrays of various types of radiators of electromagnetic radiation, such as infrared (IR) radiators, microwave radiators, or more conventional heaters, such as convection heaters. After passing by the heater 192, the substrates are transferred to the other set of belts 164 for transport to the exit of the dryer while the air vent system cools the substrates. The pre-treating unit 120, the marking unit 140, and the dryer 160 are operated by a controller 130. The controller is configured with programmed instructions stored in a memory operatively connected to the controller so the controller performs functions in the printer by operating various printer components when the controller executes the stored programmed instructions. Although only one controller is shown in FIG. 1 for simplicity, multiple controllers can be used for the various functions and these controllers can communicate with one another to synchronize the functions that they perform.

Figure 2A:
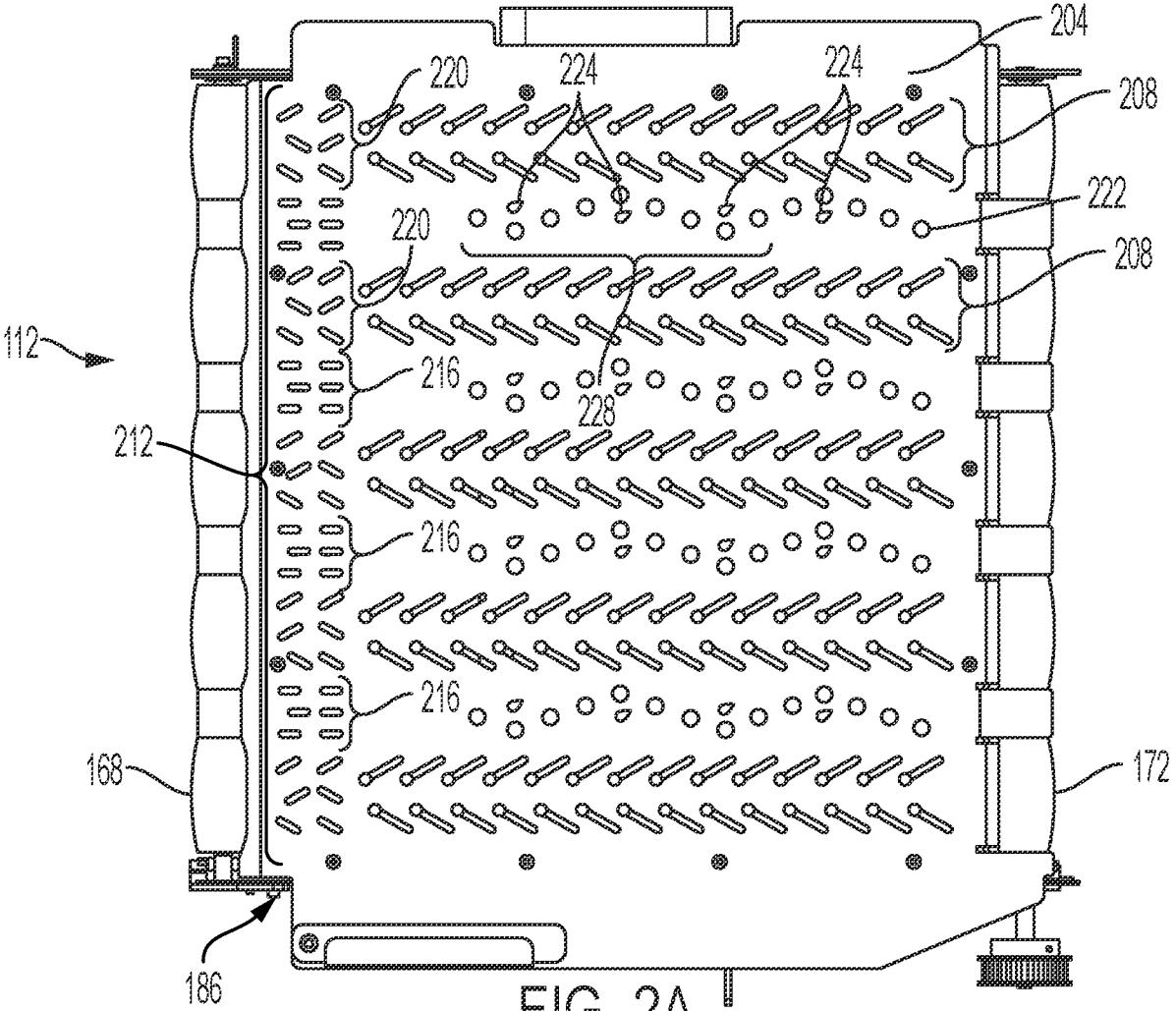
FIG. 2A is a top view of the platen covering plenum 186' in the dryer 160' of FIG. 1 without the belts and FIG. 2B is the same view with the belts in place.
Figure 2B:
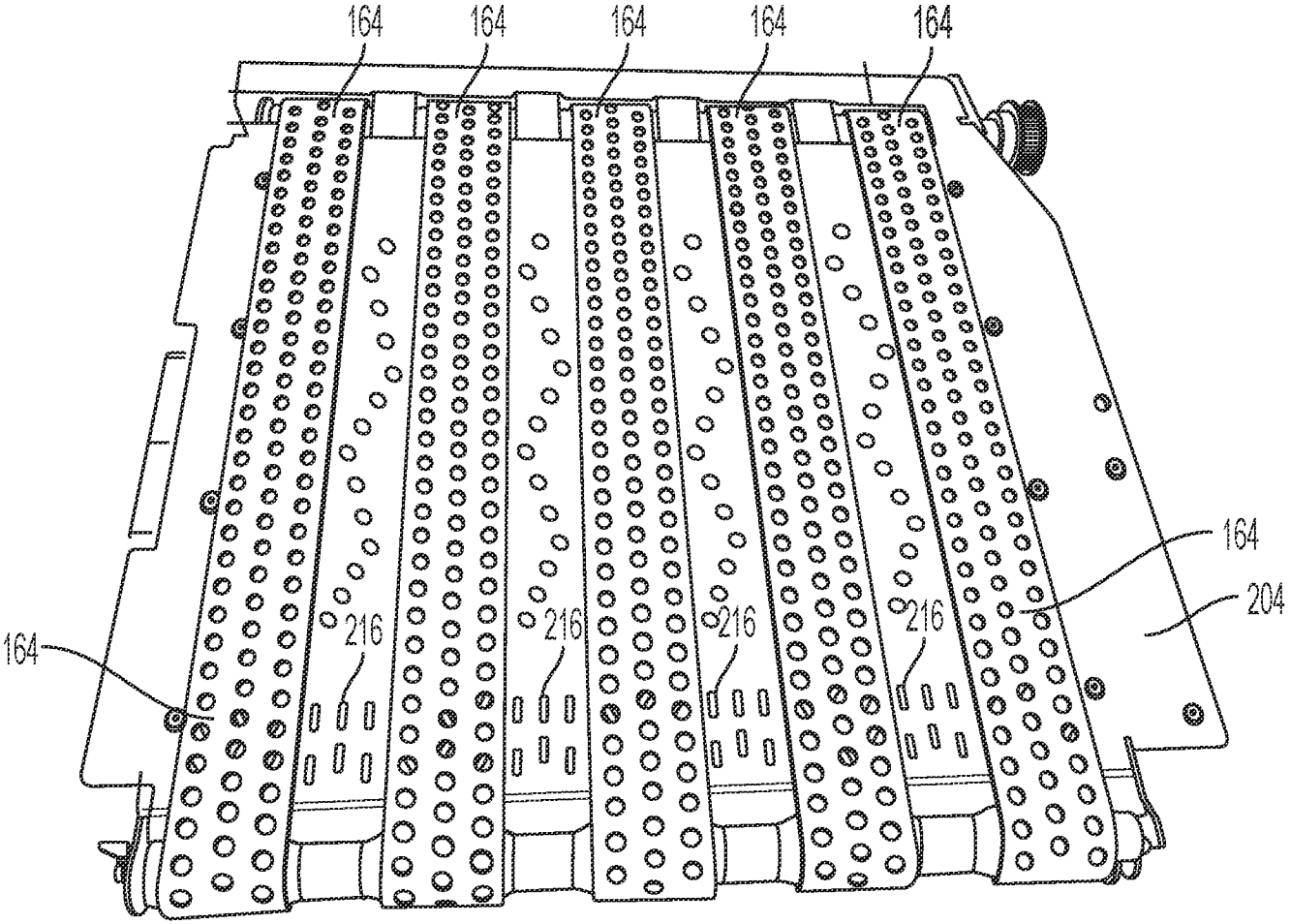

FIG. 2A is a top view of platen 204 that covers plenum 186 without the belts 164 that rotate about the plenum and FIG. 2B shows the platen with the belts in place. As used in this document, the term "platen" means a planar member configured to cover a plenum operatively connected to a negative air pressure source or vacuum. This platen is wide enough to cover the width of the space between the sidewalls of the plenum 186 and the platen is long enough to cover the space extending in the process direction 112 between the endwalls of the plenum 186. This coverage ensures the integrity of the vacuum established by the vacuum blower 188 within the plenum 186. Five double rows of elongated openings 208 extend across the surface of the platen 204. Five belts that constitute the set of belts 164 (FIG. 2B) that rotate about the plenum 186 move over these five double rows of openings. Thus, the holes in the set of belts 164 cooperate with the openings in the double rows of elongated openings 208 to form passageways intermittently for air to flow through the substrates carried by the belts and into the plenum 186. The elliptical openings 212 also help establish air flow into the plenum 186 through the substrates, the belts, and the platen. These openings are arranged in sets 216 of openings aligned in the process direction with the areas between the five double rows 208 of openings and sets of openings 220 aligned with the five double rows 208 that are angled with regard to the process direction.

With further reference to FIG. 2A, a plurality of protuberances 222 that extend toward the belts passing over the platen are positioned between each of the five double rows 208. These protuberances, or dimples as they are sometimes called in this document, are arranged in a sine wave pattern that extends in the process direction, although other non-linear arrangements of the protuberances extending in the process direction could be used. As used in this document, the term "non-linear arrangement" means a plurality of protuberances in which the protuberances are not distributed in a straight line between the two outermost protuberances in the plurality. These protuberances support the substrates passing over the platen so the substrates do not contact the plane of the platen. These protuberances extending between the plane of the platen and the substrates are warmer and present less surface area to the substrates than the plane of the platen and they enable air to insulate the substrates from the surface of the platen so little or no transfer of ink from previously printed images occurs when duplex images are printed. In one embodiment, the protuberances have a diameter of about 0.5 mm or less at the surface of the platen and they extend from the surface of the platen by no more than the thickness of the belts 164 carrying substrates over the plenum 186. The protuberances have a dome shape, which means a half-spherical shape. Additionally, the non-linear arrangement of the protuberances should extend in the process direction for a distance corresponding with the longest length of substrate printed by the printer and have at least one maximum and at least one minimum point in the non-linear arrangement. In one embodiment, the platen surface had a length of 330 mm and a width of 30 and the belt had a thickness of about 1 mm so the protuberances had a height of about 0.85 mm with a diameter of about 4 mm. The distance between adjacent protuberances in the arrangement was about 2 mm and the period of the sine wave was about 60 mm and it occurred about 2.5 times over a distance of about 280 mm. The distance between the outermost non-linear arrangements of the protuberances in the cross-process direction was about 30 mm.

Interspersed in each sine wave pattern is a plurality of tear-shaped holes 224. The holes 224 are provided to prevent solvents from collecting on the substrates and these holes are tear-shaped to reduce the risk of substrate edges catching in the holes. As used in this document, the term "tear-shaped" means a circular opening that tapers to an end that is narrower than the diameter of the circular opening. The maximum diameter of the circular opening in these holes is about double the distance between adjacent protuberances in a non-linear arrangement of the protuberances.

Figure 3:
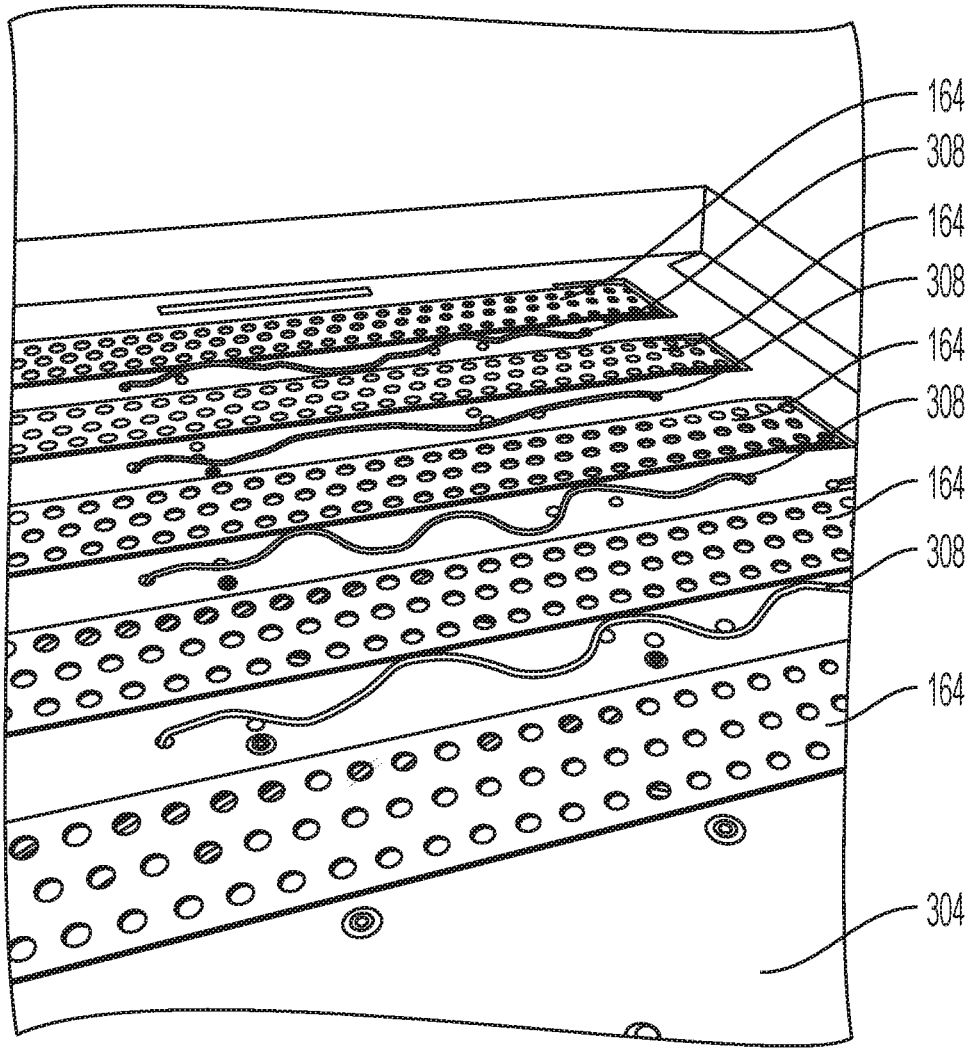
FIG. 3 is a top view of the platen covering plenum 184' in the dryer of FIG. 1.
Figure 4:
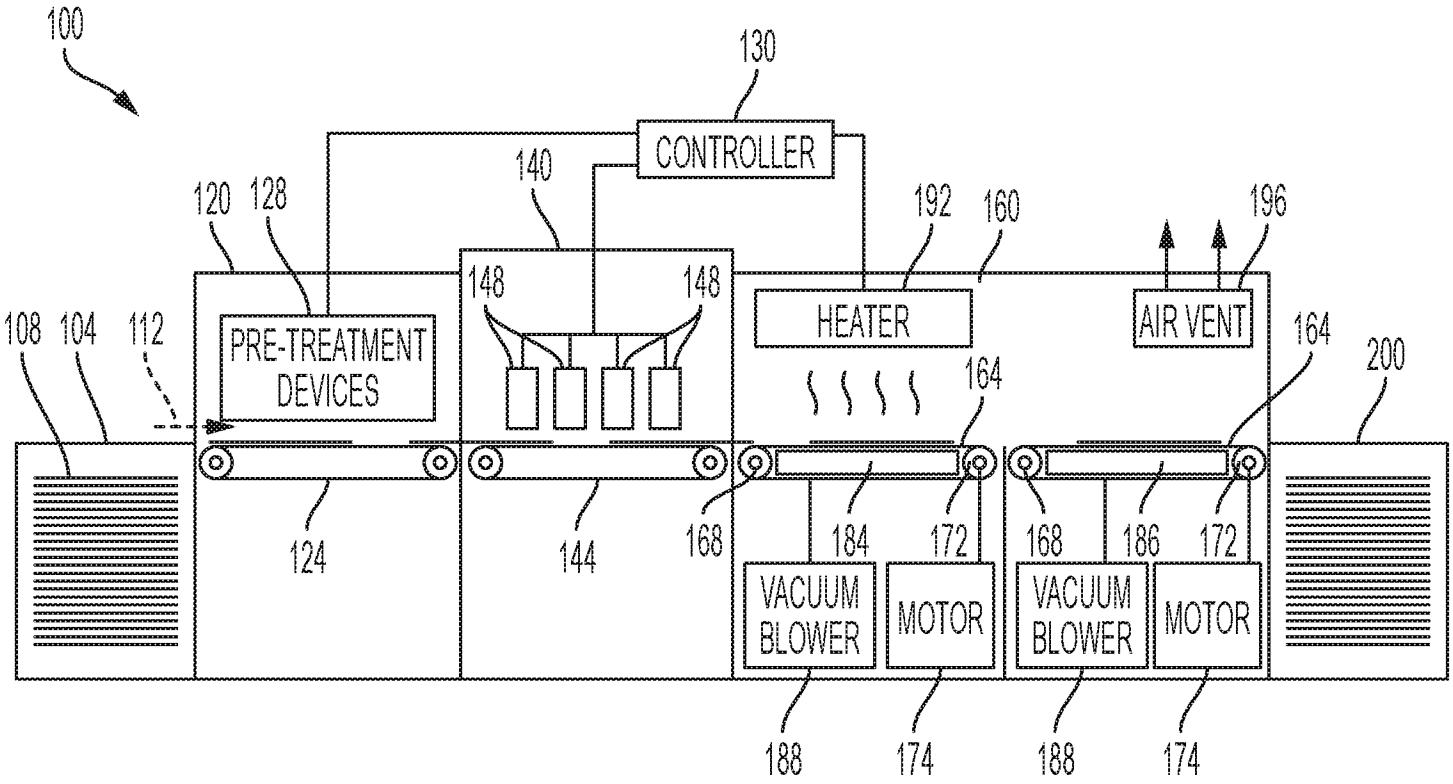
FIG. 4 PRIOR ART
FIG. 4 is a schematic diagram of a prior art aqueous ink printing system having a dryer with smooth perforated platens covering the plenums that cause ink transfer to the platens during duplex printing.

The platen 304 covering plenum 184 in the printer of FIG. 1 is shown in FIG. 3 with the endless belts that rotate about the plenum. This platen 304 includes lengths of wire 308 that are positioned between the endless belts 164 rotating about the plenum 184 and that extend in the process direction. These wires are non-linear shape and in one embodiment are in the shape of a sine wave. These wires are described as non-linear members in this document, which means that the body of the member or wire does not extend between the two endpoints of the member in a straight line. In one embodiment, the wires have a diameter that is less the thickness of the belts 164 carrying substrates over the plenum 184. Additionally, the straight-line distance between the ends of each wire corresponds with the longest length of substrate printed by the printer and have at least one maximum point and at least one minimum point in the curving shape. In one embodiment, the platen surface had a length of 330 mm and a width of 30 and the belt had a thickness of about 1 mm so the wire diameter was about 0.85 mm, the period of the sine wave was about 60 mm and it occurred about 2.5 times over a straight-line distance between the ends of a wire of about 280 mm. The distance between the outermost wires in the cross-process direction was about 30 mm. These wires support the substrates and provide less surface area for contact with the substrates. The wires enable the substrates to release water and solvent vapors without the substrates cockling. To reduce cockling in the substrates opposite the heater 192 and attenuate the transfer of ink to the platen over plenum 186, the platen of FIG. 3 is incorporated in the plenum 184 and the platen of FIG. 2 is incorporated in the plenum 186.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

at least one printhead configured to eject drops of an ink onto substrates moving past the at least one printhead to form ink images on the substrates; and a dryer having a heater, an air vent, at least two plenums with at least one plenum being opposite the heater and at least one plenum being opposite the air vent, a first plurality of endless belts configured to rotate in a process direction about the at least one plenum opposite the heater and a second plurality of endless belts configured to rotate about the at least one plenum opposite the air vent, and a platen positioned to cover the plenum opposite the air vent so the second plurality of endless belts moves over the platen as the endless belts in the second plurality of endless belts rotate about the at least one plenum opposite the air vent, the platen having a plurality of protuberances in a non-linear arrangement between each pair of adjacent endless belts in a cross-process direction that is perpendicular to the process direction so the protuberances contact substrates being carried by the second plurality of endless belts to prevent the substrates from contacting a surface of the platen.

2. The inkjet printer of claim 1 wherein the non-linear arrangement of the plurality of protuberances is a sine wave that extends in the process direction.

3. The inkjet printer of claim 2 wherein the protuberances extend from the surface of the platen at a distance less than a thickness of the endless belts in the second plurality of endless belts.

4. The inkjet printer of claim 3, the platen further comprising;

a plurality of openings in the platen, the openings being distributed through each sine wave arrangement of the protuberances between each adjacent pair of endless belts in the second plurality of endless belts.

5. The inkjet printer of claim 4 wherein the openings are tear-shaped.

6. The inkjet printer of claim 5 wherein the protuberances are dome shaped.

7. The inkjet printer of claim 6 wherein the protuberances have a diameter of no more than 0.5 mm at a base of each dome shaped protuberance at the surface of the platen.

8. The inkjet printer of claim 7 further comprising:

a platen positioned to cover the plenum opposite the heater so the first plurality of endless belts moves over the platen as the endless belts in the first plurality of endless belts rotate about the at least one plenum opposite the air vent, the platen having a plurality of non-linear members between each pair of adjacent endless belts in the cross-process direction so the non-linear members contact substrates being carried by the first plurality of endless belts to prevent the substrates from contacting a surface of the platen.

9. The inkjet printer of claim 8 wherein the non-linear members are configured in a sine wave that extends in the process direction.

10. The inkjet printer of claim 9 wherein the non-linear members have a diameter that is less than a thickness of the endless belts in the first plurality of endless belts.

11. The inkjet printer of claim 10, the platen further comprising;

a plurality of openings in the platen, the openings being distributed on alternate sides of the non-linear members between each adjacent pair of endless belts in the first plurality of endless belts.

12. The inkjet printer of claim 4 wherein the openings are tear-shaped.

13. A dryer for an inkjet printer comprising:

a heater;

an air vent;

at least two plenums, at least one plenum is opposite the heater and at least one plenum is opposite the air vent;

a first plurality of endless belts configured to rotate in a process direction about the at least one plenum opposite the heater;

a second plurality of endless belts configured to rotate about the at least one plenum opposite the air vent; and a platen positioned to cover the plenum opposite the air vent so the second plurality of endless belts moves over the platen as the endless belts in the second plurality of endless belts rotate about the at least one plenum opposite the air vent, the platen having a plurality of protuberances in a non-linear arrangement between each pair of adjacent endless belts in a cross-process direction that is perpendicular to the process direction so the protuberances contact substrates being carried by the second plurality of endless belts to prevent the substrates from contacting a surface of the platen.

14. The dryer of claim 13 wherein the non-linear arrangement of the plurality of protuberances is a sine wave that extends in the process direction.

15. The dryer of claim 14 wherein the protuberances extend from the surface of the platen at a distance less than a thickness of the endless belts in the second plurality of endless belts.

16. The dryer of claim 15, the platen further comprising;

a plurality of openings in the platen, the openings being distributed through each sine wave arrangement of the protuberances between each adjacent pair of endless belts in the second plurality of endless belts.

17. The dryer of claim 16 wherein the openings are tear-shaped.

18. The dryer of claim 17 wherein the protuberances are dome shaped.

19. The dryer of claim 18 wherein the protuberances have a diameter of no more than 0.5 mm at a base of each dome shaped protuberance at the surface of the platen.

20. The dryer of claim 19 further comprising:

a platen positioned to cover the plenum opposite the heater so the first plurality of endless belts moves over the platen as the endless belts in the first plurality of endless belts rotate about the at least one plenum opposite the air vent, the platen having a plurality of non-linear members between each pair of adjacent endless belts in the cross-process direction so the non-linear members contact substrates being carried by the first plurality of endless belts to prevent the substrates from contacting a surface of the platen.

21. The dryer of claim 20 wherein the non-linear members are configured in a sine wave that extends in the process direction.

22. The dryer of claim 21 wherein the non-linear members have a diameter that is less than a thickness of the endless belts in the first plurality of endless belts.

23. The dryer of claim 22, the platen further comprising;

a plurality of openings in the platen, the openings being distributed on alternate sides of the non-linear members between each adjacent pair of endless belts in the first plurality of endless belts.

24. The dryer of claim 23 wherein the openings are tear-shaped.

25. A platen configured to cover a plenum that is opposite an air vent in a dryer of an inkjet printer, the platen comprising:

a planar member having a length in a process direction and width in a cross-process direction perpendicular to the process direction that covers the plenum that is opposite the air vent so a plurality of endless belts moves over the planar member as the endless belts in the plurality of endless belts rotate about the plenum that is opposite the air vent; and a plurality of protuberances extending from a surface of the planar member, the plurality of protuberances being configured in a non-linear arrangement between each pair of adjacent endless belts in the cross-process direction so the protuberances contact substrates being carried by the plurality of endless belts to prevent the substrates from contacting the surface of the planar member.

26. The platen of claim 25 wherein the non-linear arrangement of the plurality of protuberances is a sine wave that extends in the process direction.

27. The platen of claim 26 wherein the protuberances extend from the surface of the platen at a distance less than a thickness of the endless belts in the plurality of endless belts.

28. The platen of claim 27, the platen further comprising;

a plurality of openings in the platen, the openings being distributed through each sine wave arrangement of the protuberances between each adjacent pair of endless belts in the plurality of endless belts.

29. The platen of claim 28 wherein the openings are tear-shaped.

30. The platen of claim 29 wherein the protuberances are dome shaped.

31. The platen of claim 30 wherein the protuberances have a diameter of no more than 0.5 mm at a base of each dome shaped protuberance.

* * * * *